US008276305B1

(12) United States Patent
Leutenegger et al.

(10) Patent No.: US 8,276,305 B1
(45) Date of Patent: Oct. 2, 2012

(54) SHOT PATTERN CONTROL SYSTEM

(76) Inventors: Larry Leutenegger, Holidaysburg, PA (US); Gerald E. Poe, Black Earth, WI (US)

( * ) Notice: Subject to any disclaimer, the term of this patent is extended or adjusted under 35 U.S.C. 154(b) by 965 days.

(21) Appl. No.: 11/926,670

(22) Filed: Oct. 29, 2007

Related U.S. Application Data

(63) Continuation-in-part of application No. 11/430,354, filed on May 9, 2006, now Pat. No. 7,523,581.

(51) Int. Cl.
*F41A 21/00* (2006.01)

(52) U.S. Cl. ..... 42/79; 42/1.06; 89/14.3; 89/14.6

(58) Field of Classification Search ..... 42/79, 1.06; 89/14.6, 14.3
See application file for complete search history.

(56) References Cited

U.S. PATENT DOCUMENTS

| | | | | | |
|---|---|---|---|---|---|
| 2,150,161 | A * | 3/1939 | Green | 89/14.3 |
| 2,589,171 | A * | 3/1952 | Vironda | 42/79 |
| 2,668,479 | A * | 2/1954 | Batten | 89/14.3 |
| 2,765,706 | A * | 10/1956 | Strohl | 89/14.3 |
| 2,779,119 | A * | 1/1957 | Fawcett | 42/79 |
| 2,872,848 | A * | 2/1959 | Schuessler | 89/14.3 |
| 3,367,055 | A * | 2/1968 | Powell | 42/79 |
| 3,867,778 | A * | 2/1975 | Preda et al. | 42/79 |
| 4,071,971 | A * | 2/1978 | Tornas | 42/79 |
| 5,249,385 | A * | 10/1993 | Vang et al. | 42/79 |
| 5,272,827 | A * | 12/1993 | Vang et al. | 42/79 |
| 5,452,535 | A * | 9/1995 | See et al. | 42/79 |
| 5,463,930 | A * | 11/1995 | Bisping et al. | 89/29 |
| 6,065,384 | A * | 5/2000 | Widder et al. | 89/14.05 |
| 6,112,447 | A * | 9/2000 | Androsov | 42/79 |
| 6,128,846 | A * | 10/2000 | Walker et al. | 42/79 |
| 2005/0011102 | A1 * | 1/2005 | Boyer | 42/79 |

* cited by examiner

*Primary Examiner* — Michael Carone
*Assistant Examiner* — Samir Abdosh
(74) *Attorney, Agent, or Firm* — Murphy Desmond S.C.

(57) ABSTRACT

The invention relates to systems, methods and devices for controlling the dispersion of shot or other projectiles fired from a weapon such as a shotgun. Embodiments according to the invention employ an inner cylindrical chamber that is divided at a median transverse plane into forward and rear sections. The rear section of the chamber tapers toward the median transverse plane and includes a number of radial vents that open into an outer chamber that provides one or more gas bypass channels into the forward section of the tubular chamber. Alternatively, channels function as unitary vents and outer chamber to provide for a gas bypass. The forward section tapers toward a forward muzzle opening. When a multiple projectile load/wad is fired from the weapon, expanding gas is sealed behind the load until it has advanced past the radial vents at which point, gas is allowed to expand into the outer chamber resulting in a momentary pressure drop and reduced propulsion force behind the wad/load. The relatively light wad decelerates while the much heavier shot continues forward, rapidly separating from the wad before the wad exits the muzzle. The wad seals against the tapered bore of the forward section of the inner chamber blocking the escape of gas from the outer chamber passageways until sufficient pressure develops to eject the wad from the muzzle end.

4 Claims, 7 Drawing Sheets

SHOT PATTERN CONTROL SYSTEM

RELATED APPLICATION

The present application claims priority from and is a continuation-in-part of U.S. patent application Ser. No. 11/430,354 filed 9 May 2006 now U.S. Pat. No. 7,523,581.

TECHNICAL FIELD

The present invention relates generally to controlling the discharge pattern of projectiles fired from a weapon, and more particularly to systems, methods, and devices to achieve improved shot pattern control and extended target range in weapons such as the conventional shotgun.

BACKGROUND

The conventional smooth bore shotgun and similar multiple projectile weaponry disperses shot in a pattern that diverges rapidly after it has left the muzzle. This characteristic fan out increases the probability of a hit at short range but limits the weapon's effectiveness as the distance to target increases. At a distance of only 40 yards, for example, lead shot fired from a conventional 12 gauge shotgun will typically deliver only 40 percent of the shot inside a 30 inch circle. This reduced pellet density can shorten the effective range of the shotgun to about 20 yards.

In order to tighten the shot pattern and extend the effective range of a shotgun, the barrel may be constricted or "choked" at or near the muzzle end. The constriction can range from as little as 0.005 inches for skeet shooting, to about 0.050 inches for shooting at more distant targets. While the barrel itself is often designed to have some built-in choke, detachable and interchangeable "choke tubes" of varying constrictions are commonly used to adapt the conventional shotgun for use in a variety of different shooting scenarios.

Although traditional choke tubes and choked barrels can reduce shot pattern spread, there is a limit to the amount of shot pattern control that a conventional choke tube can provide and there is a high degree of pattern variability and density from shot to shot. The large number of shotgun choke systems that have been developed over the years demonstrates the difficulty of the problem.

Recently, choke tubes and choke systems that retard the shot wad before it exits the muzzle have been introduced in an effort to prevent the wad and turbulent gas behind from interfering with the shot in the instant after the shot exits the muzzle. For example, U.S. Pat. No. 5,452,535, issued Sep. 26, 1995 to See et al. ("'535 patent"), discloses wad retardation devices that employ radial projections such as ridges, pins, studs, or set screws, or an applied grit that extend inwardly around an inner circumference of a barrel in order to retard the velocity of the wad before it exits the muzzle. Interference with the shot trajectory and pattern by the wad and gas turbulence downstream of a shotgun muzzle may thus be inhibited. U.S. Pat. No. 6,128,846, issued on Oct. 10, 2000 ("'846 patent"), of which an applicant hereunder is named a co-inventor, discusses improvements to the devices in the '535 patent.

Devices manufactured according to the '535 and '846 patents demonstrably improve shotgun shot pattern consistency and predictability. However, improvements in shot pattern control methods and devices are still needed. For example, the radial projections needed by such devices must be machined to very close tolerances which can add significantly to the cost of manufacture. Moreover, the projections are positioned directly in the path of the accelerating shot and wad and are thus subjected to wear every time the gun is fired and will eventually become worn to the point that they are no longer effective. The use of "hard" shot materials such as bismuth, steel, tungsten-iron, tungsten-nickel-iron and tungsten polymer exacerbates the problem. Thus, it would be advantageous to provide a system that effectively retards the wad and thereby inhibits shot interference and shot pattern distortion from the wad and gas turbulence downstream of a shotgun muzzle without employing radial projections such as ridges, pins, studs, screws, grit or abrasives. Of course, any such system should also achieve consistent, predictable and focused shot patterns, be adaptable to a variety of shot spreads for long and short range shooting scenarios, and at the same time be safe, durable and easy to use. Embodiments according to the present invention are directed to addressing the foregoing needs.

SUMMARY

In general, in one aspect, a shot pattern control system for a multiple-projectile-firing-weapon according to the present invention includes a cylindrical inner chamber that extends longitudinally between a rear opening and a muzzle end opening and that has a rear section positioned behind a median transverse plane and a forward section position in front of the median transverse plane, a radial vent in the rear section of the tubular chamber, and an outer chamber having a gas bypass channel that extends from the radial vent into the forward section of the tubular chamber.

In general, in another aspect, a method for separating a wad from a multiple projectile load before the multiple projectile load exits the muzzle includes propelling the wad and multiple projectile load by an expanding column of gas down the barrel of a gun, and laterally releasing a portion of the propulsion gas behind the wad after the multiple projectile load has progressed down the barrel a predetermined distance to effect a reduction in gas pressure behind the wad and a wad separation from the multiple projectile load.

DETAILED DESCRIPTION

Figure 1:
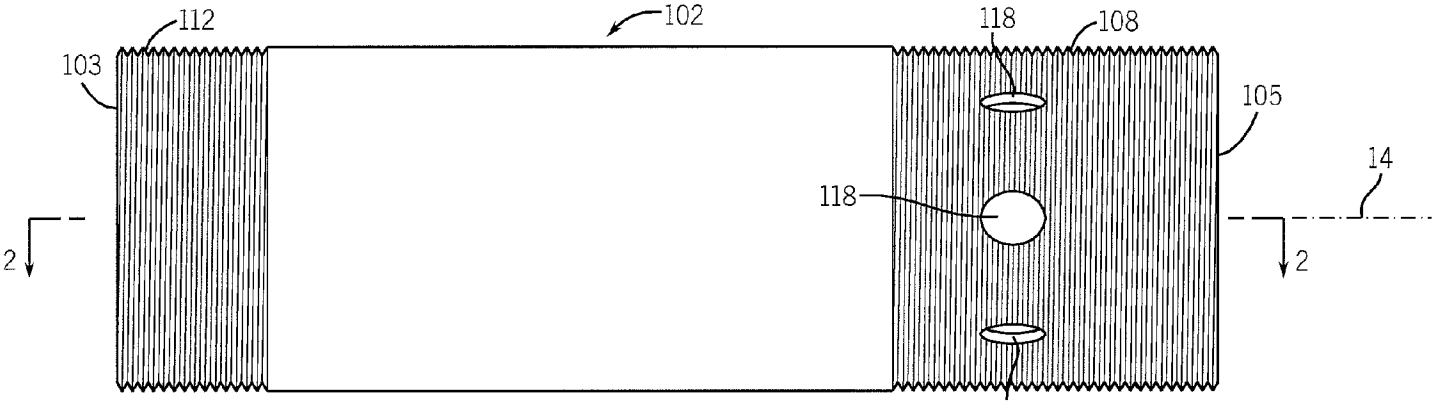
FIG. 1 shows an external view of a tubular section of a shot pattern control device system according to the present invention.
Figure 2:
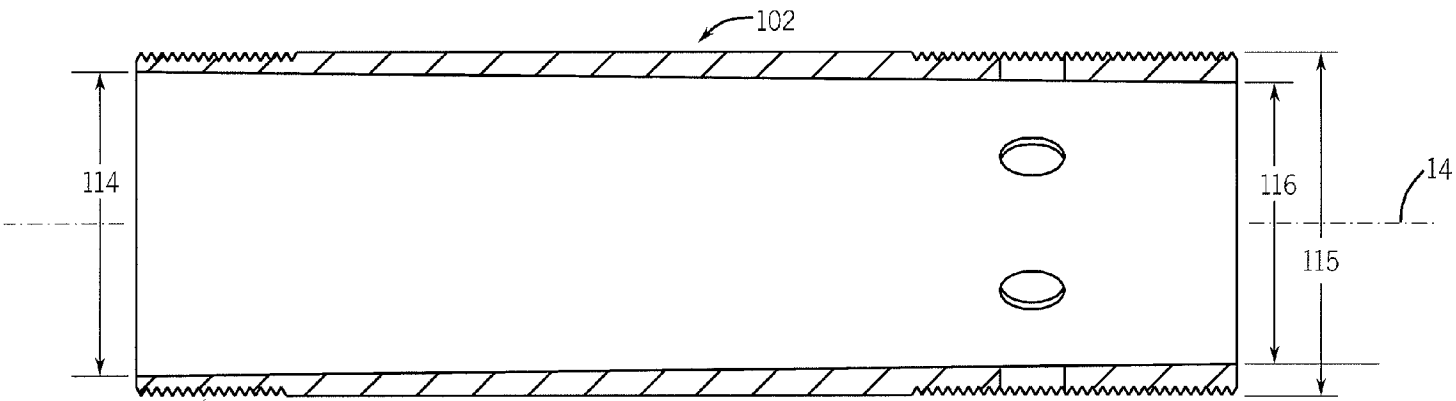
FIG. 2 shows a side sectional view of the tubular section of FIG. 1.

In the following detailed description, reference is made to the accompanying drawings. The drawings form a part of this invention disclosure and show, by way of illustration, specific embodiments in which the invention, as claimed, may be practiced. The invention may, however, be embodied in many different forms and should not be construed as limited to the embodiments set forth; rather, these embodiments are provided so that this disclosure will be thorough and complete, and will fully convey the scope of the invention to those skilled in the art. As will be appreciated by those of skill in the art, the present invention may be embodied in methods and devices. Wherever possible, the same reference numbers will be used throughout the drawings to refer to the same or like parts. The drawings herein have deliberately not been made to scale in order to illustrate aspects of the present invention that might otherwise be difficult to see. The term "wad" as used herein means any wadding, shot cup, sabot, or packing material that seals expanding gas from a charge behind one or more projectiles fired from a barrel or launch tube. The term includes, but is not limited to, a conventional shotgun shot cup that provide one or more sections or compartments to carry gunshot or similar projectiles fired from the barrel of a gun.

In general, a shot pattern control system according to the present invention provides a longitudinally extending inner cylindrical chamber that is divided at a median transverse plane into a forward section and a rear section. The rear section of the cylindrical chamber tapers toward the median transverse plane. The inner chamber widens abruptly at the median transverse plane and the forward section tapers as it extends forward from the median transverse plane to a muzzle opening. The inner chamber includes a number of radial gas vents that allow propulsion gas to escape into an outer chamber. The outer chamber provides an expansion chamber and bypass channel that conveys gas from the rear section into the forward section after the wad or cartridge has advanced past the radial vents in order to effect wad separation from the shot, as described below.

As shown in FIGS. 4-8, shot pattern control system 100 provides an inner cylindrical chamber 101 that extends longitudinally between rear opening 103 facing the chamber end of the weapon and a forward or muzzle opening 120 on the opposite end. Inner cylindrical chamber 101 may be divided into a forward section 107 located in front of a median transverse plane 132 and a rear section 109 located behind it. The rear section 109 of inner cylindrical chamber 101 tapers from the rear to a median plane 132. In this embodiment, inner chamber 101 widens abruptly at median transverse plane 132 and tapers again as it extends to a muzzle opening 120.

Referring to FIGS. 1-4, in an embodiment, inner chamber 101 may be formed of an elongate tube 102 and a collar 104. Tube 102 extends longitudinally between rear opening 103 and a forward opening 105 at median transverse plane 132. Collar 104 surrounds tube 102 enclosing approximately the forward one-third and extends past forward end 105 to form forward section 107 which ends at muzzle end opening 120. Both tube 102 and collar 104 are centered on a longitudinal axis 14 and are preferably made from a hardened alloy such as tungsten steel, but may be fabricated from a variety of other metal or composite materials as would be known to those of skill in the gunsmith arts.

A number of radial vents 118 are provided through the sidewall of tube 102 in rear section 109. Vents 118 act as valves that convey gas laterally into a chamber 123 located between the outside wall of tube 102 and the inside wall of collar 104. Chamber 123 extends from rear section 109 into forward section 107. A ring of eight equally spaced radial vents 118 of the same size that are generally oval in shape and are oriented with the long oval axes parallel to axis 14 provide a radially balanced distribution of gas. While eight radial vents 118 have been illustrated, a greater or lesser number of openings may be provided in alternative embodiments. Additionally, while oval-shaped vents are preferred, in alternative embodiments, other shapes such as circular or slotted openings, for example may be used.

From an external viewpoint tube 102 generally forms a straight cylinder. Internally, however, tube 102 tapers from rear opening 103 to median plane 132 decreasing uniformly from a first diameter 114 corresponding to the bore of the gun barrel to a second diameter 116 to the rear of median transverse plane 132. Inner chamber 101 widens abruptly to a third diameter 130 at median transverse plane 132 and tapers again to a fourth or muzzle opening diameter 128 as it extends to muzzle end opening 120. First diameter 114 is dimensioned to correspond to the gauge of the barrel to which the shot pattern control device 100 attaches and to enable a threading engagement to the inside bore of the muzzle. Second diameter 116 is dimensioned to be slightly narrower than the outside diameter of the shot wad to ensure that radial vents 118 are tightly sealed and propulsion gas pressure is maintained behind the wad until the wad has advanced past the vents. After the wad and shot column have advanced past vents 118 propulsion gas is allowed to escape laterally and expand forward into outer chamber 123.

Figure 3:
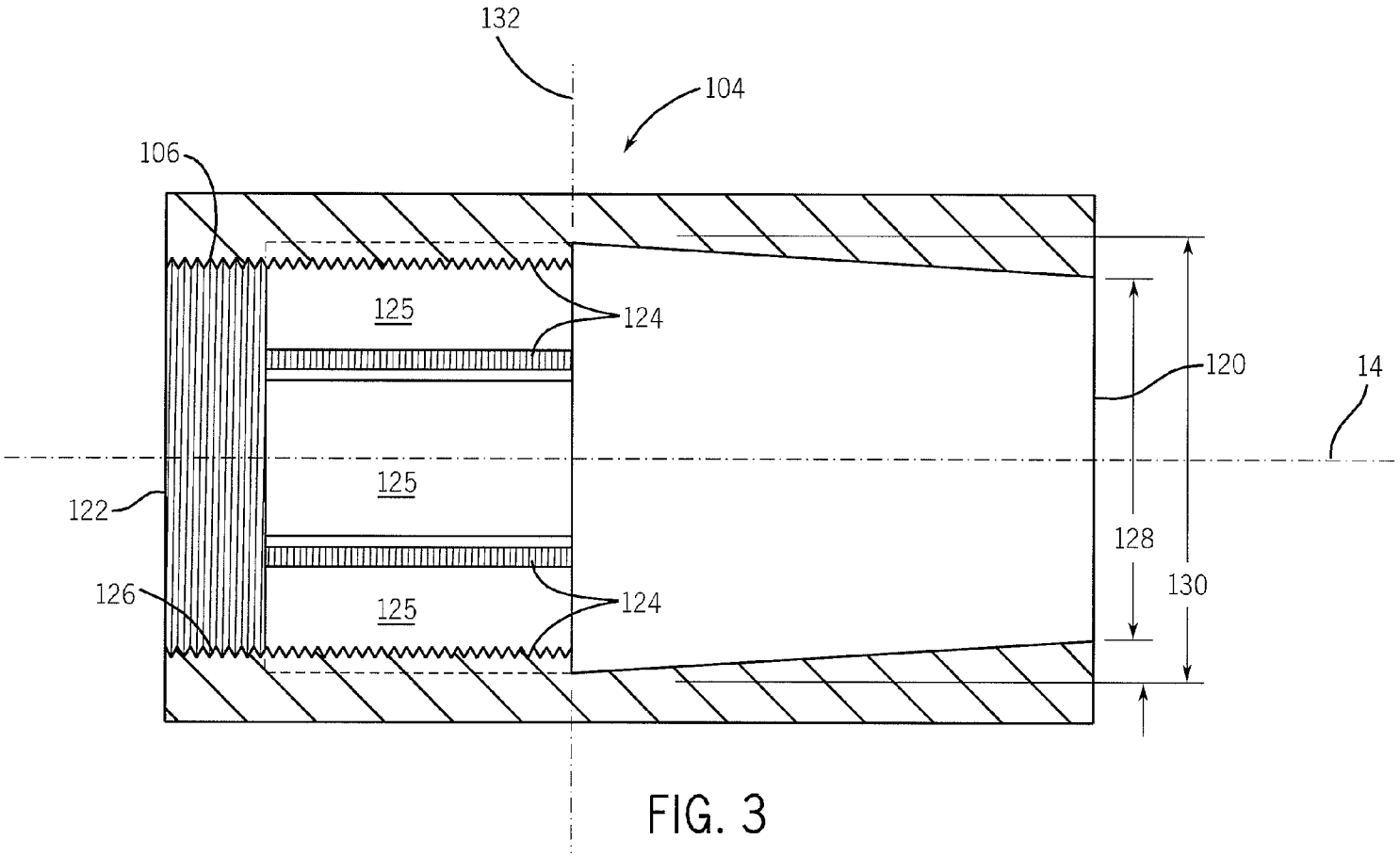
FIG. 3 shows a side sectional view of a collar of a shot pattern control device system according to the present invention.
Figure 4:
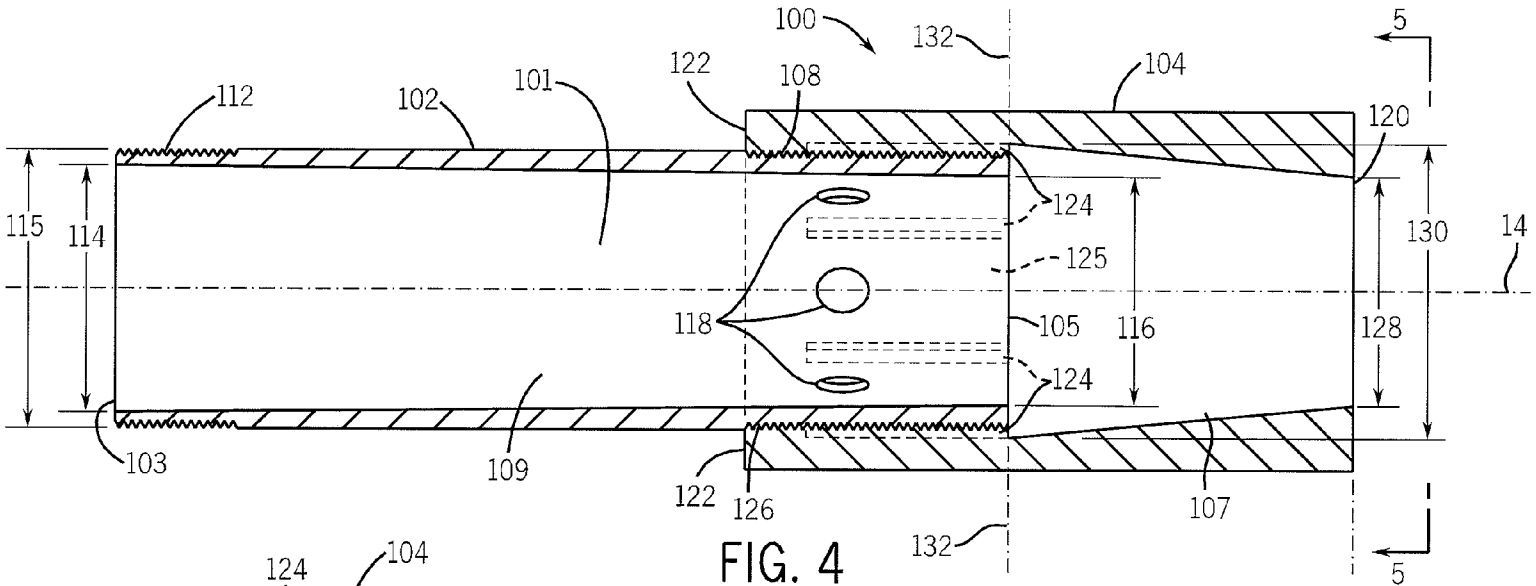
FIG. 4 shows a side sectional view of the preferred embodiment of a shot pattern control system according to the present invention.
Figure 5:
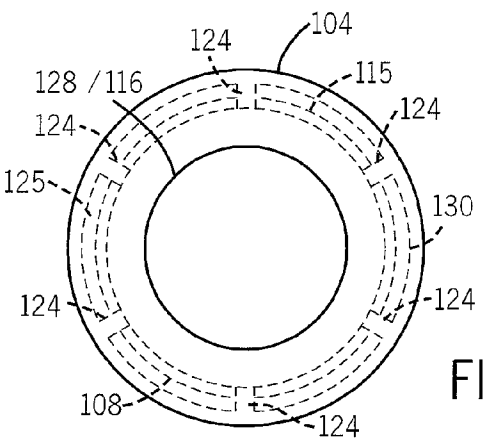
FIG. 5 shows an end view of the embodiment of FIG. 4 taken from the direction indicated by line 5-5 in FIG. 4.

Referring to FIGS. 3 and 4, collar 104 forms an outer sleeve that extends over tube 102 from a closed end 122 located behind radial vents 118, to muzzle end opening 120. Collar 104 includes an inside lip 126 at closed end 122 and provides threads 106 engage forward external threads 108 on tube 102. While a threading engagement is shown, other forms of attachment such as clamps, snap rings, clips, pins, screws, and the like, may likewise provided in alternative embodiments.

The outside wall of tube 102 and the inside wall of collar 104 in the region between threaded lip 126 and median plane 132 are separated radially by a gap that forms outer chamber 123. Dividers 124 separate chamber 123 along axis 14 into longitudinal channels 125 that deliver balanced flow of gas from each radial vent 118 through chamber 123 and into forward section 107. The taper of forward section 107 is dimensioned to sealingly engage the forward portion of the wad substantially at the same time as the rear portion has cleared radial vents 118. Thus a radially balanced pressure begins to build in forward section 107 against the wad as soon as gas is allowed into chamber 123. In this embodiment, channel dividers 124 project inwardly from collar 104 to just above the outer surface of tube 102 so as to be in substantial engagement therewith. In alternative embodiments, channel dividers 124 may project radially outwardly from tube 102, may be provided by a separate structure such as a threaded insert, or may be formed integrally with tube 102 and collar 104.

Collar 104 tapers uniformly from third diameter 130 at median plane 132 to a muzzle diameter 128 at forward or muzzle end opening 120. Muzzle diameter 128 is approximately the same size as second diameter 116 of tube 102. The longitudinal positioning of radial vents 118 is determined so that the openings are exposed when the wad has cleared the openings and its forward end is in forward section 107 with its sidewall biased sealingly against the tapered bore. The exact longitudinal positioning, of course, will depend on the length of the wad.

The connection between shot pattern control device 100 and the gun muzzle may be effected in any convenient way and will vary depending on the gun. In this embodiment, rear external threads 112 are provided on the outer sidewall surface of tube 102 at rear opening 103 for engaging internal threads conventionally provided for muzzle attachments at the muzzle end of a shotgun barrel. Forward external threads 108 are also provided on tube 102 to allow for attachment and detachment of collar 104. Alternative embodiments may provide for attachment to the gun muzzle in a variety of other ways, such as by external muzzle threads, or by the use of fasteners such as clamps, screws, pins, clips, quick release fittings, and the like, as would be familiar to those of skill in the art. Still other embodiments will integrate shot pattern control systems according to the present invention into the gun barrel itself.

Operation

Operation of an embodiment according to the present invention will now be described. When a shell is fired from a weapon that includes a shot pattern control system according to the present invention, the shot/multiple projectiles 300 travel down the gun barrel encapsulated in a wad 302 that is propelled from behind by an expanding high pressure column of gas 304. The sidewall of wad 302 is biased against the barrel sidewall and provides a seal that keeps the expanding gas 304 behind the shot laden wad as it travels down the barrel. Until wad 302 has entered shot pattern control device 100 the internal ballistic behavior is essentially the same as that of a conventional gun.

Figure 6:
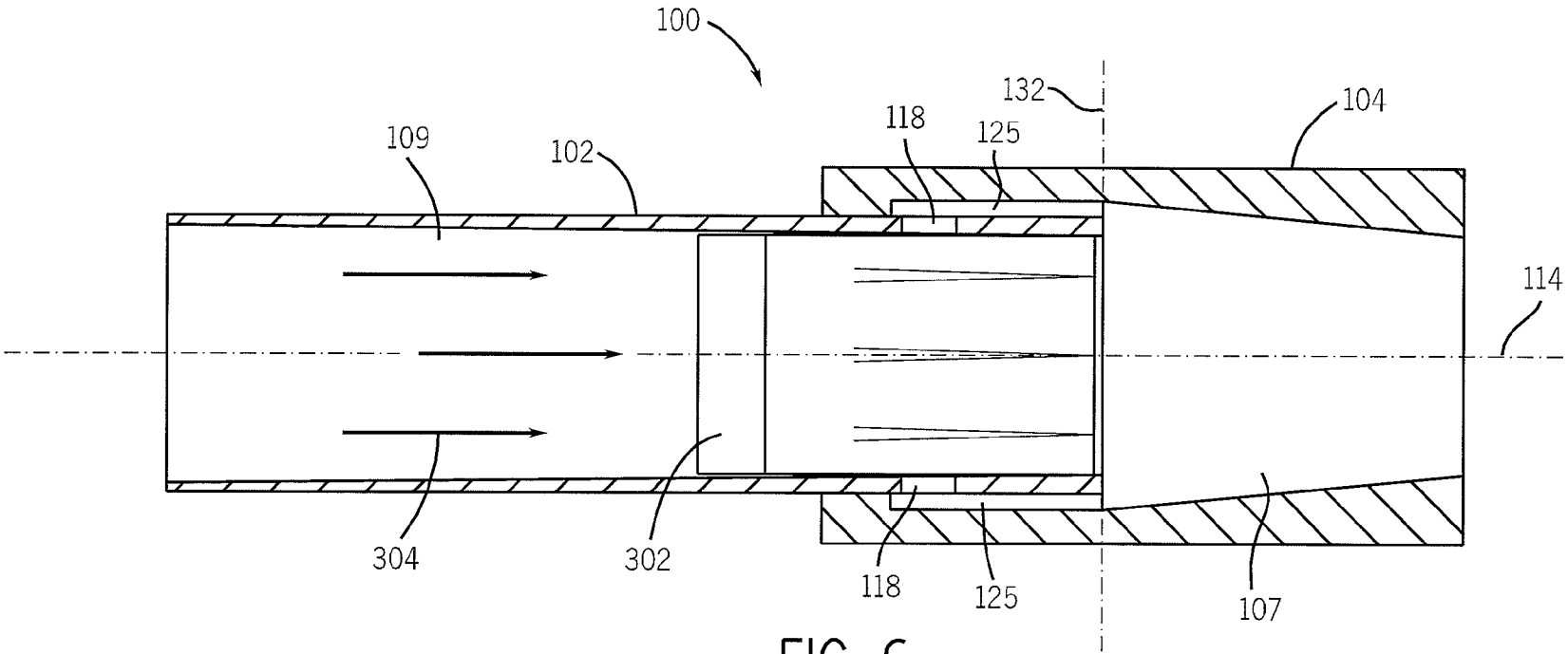
FIG. 6 shows a side sectional view of the preferred embodiment of a shot pattern control system according to the present invention in which a shot wad has advanced to a middle position.

FIG. 6 shows the point at which the front portion of wad 302 has reached median transverse plane 132 and is inside shot pattern control device 100. In this position, wad 302 completely covers and seals radial vents 118 and prevents the expanding gas 304 from passing through the openings.

Figure 7:
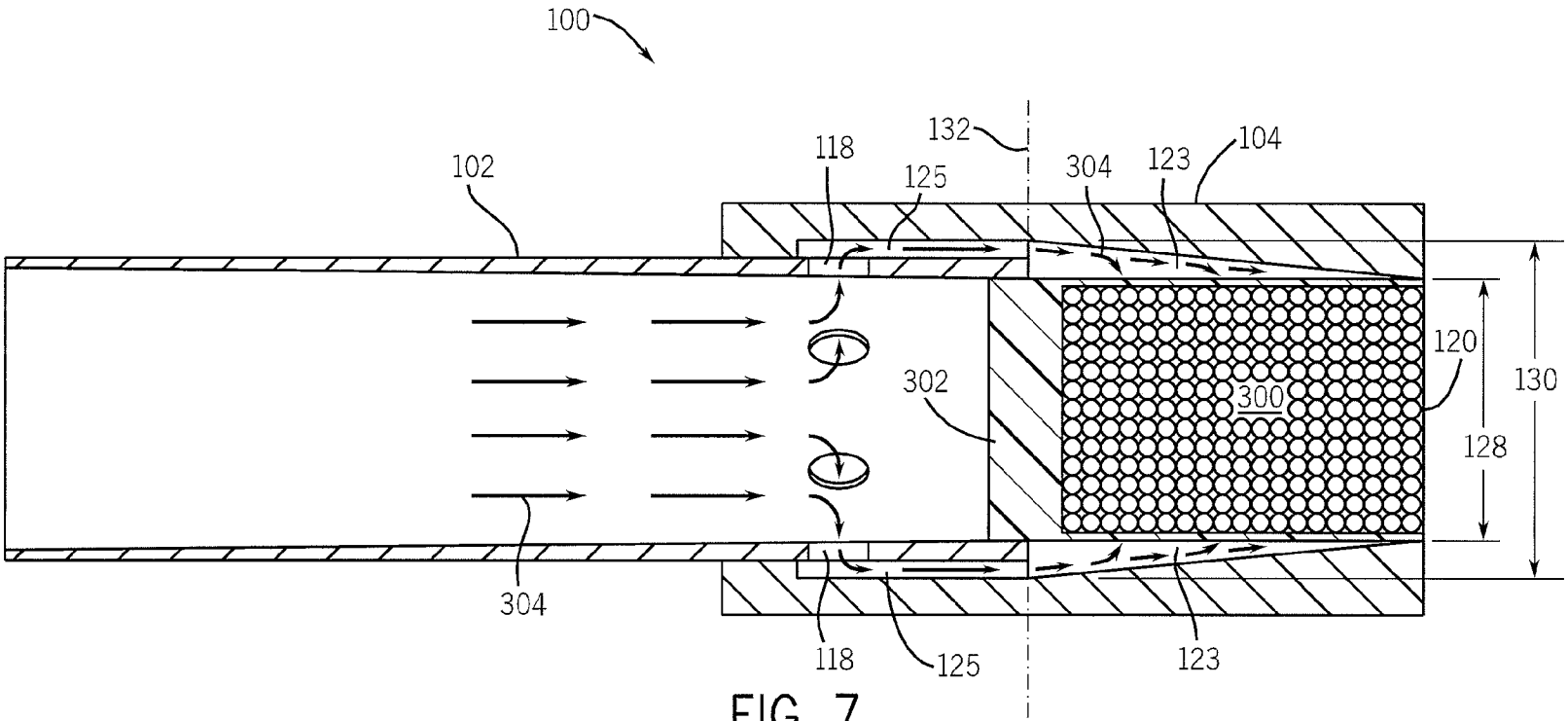
FIG. 7 shows a side sectional view of an embodiment of a shot pattern control according to the present invention in which a shot wad has advanced forward beyond the position shown in FIG. 6 to a point where it no longer covers the radial openings.
Figure 8:
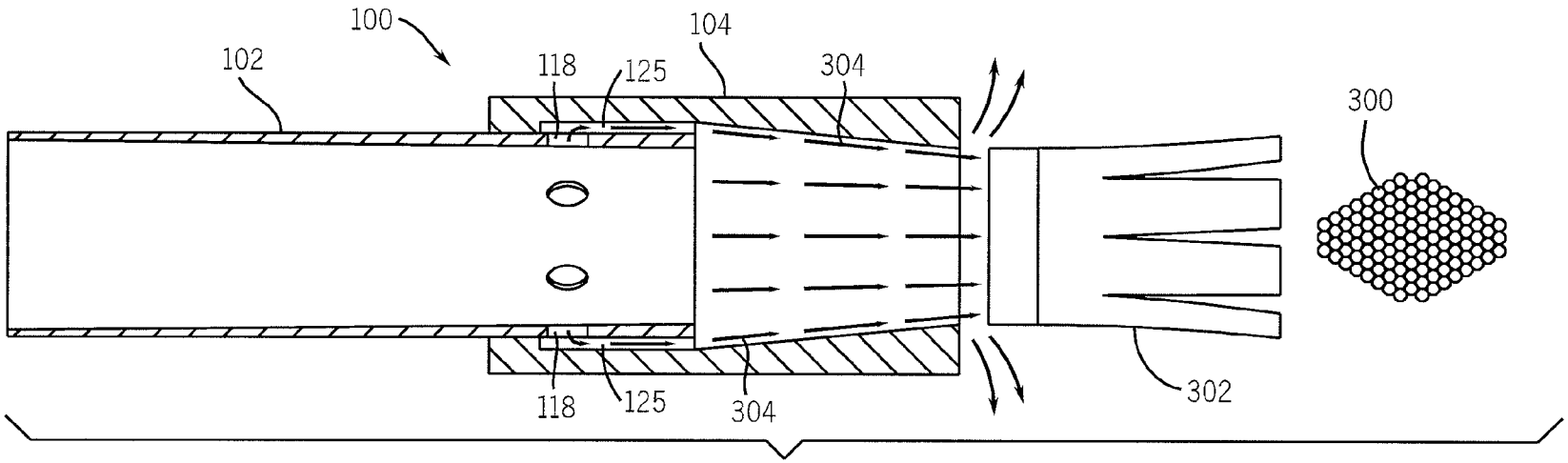
FIG. 8 shows a side sectional view of an embodiment of a choke tube system according to the present invention after the wad has exited the muzzle.

In FIG. 7, wad 302 still remains inside shot pattern control device 100 but has advanced past radial vents 118. As a consequence, radial vents 118 are open and gas 304, which is under great pressure, escapes through radial vents 118 into chamber 123. Gas 304 expands laterally and forward through longitudinal channels 125 of chamber 123 resulting in a drop in pressure behind wad 302. In effect, a valve-like and radially balanced release of gas is provided through vents 118 into chamber 123 as soon as the rear end of the wad has advanced past the openings. Gas rapidly travels forward through longitudinal channels 125 past median plane 132 and into forward section 107.

The drop in pressure behind the wad results in a momentary deceleration/retardation of the relatively light wad. The much more massive shot continues forward unimpeded and separates from the wad.

The reduction in gas pressure behind the wad is quite brief. At the same time that the rear of wad 302 has cleared radial vents 118 the forward part has advanced into the tapered forward section 107 and is biased sealingly against the tapered sidewall of forward section 107 so that outer chamber 123 is sealed at the forward end and gas pressure mounts rapidly. As pressure mounts in outer chamber 123, pressure also mounts behind wad 302 pushing it forward with increasing force. The mounting gas pressure in chamber 123 also exerts an inwardly directed radial force against the sidewall of wad 302 causing it to constrict slightly so that there may be significantly reduced friction as wad 302 passes through the narrower opening 128 of collar 104. The delay effected by the momentary pressure drop as described is sufficient to allow the shot to separate cleanly from the wad before the wad exits the muzzle.

As has been described, embodiments according to the present invention may be used to effectively prevent shot wad interference and seal substantially all of the turbulent gases behind the wad until the shot has separated completely from the wad. Additionally, embodiments of shot pattern control devices according to the present invention avoid the need for radial projections such as ridges, pins, studs, or set screws, or an applied grit, or placing of other impediments in the path of the wad which can wear out. Thus, embodiments according to the present invention are expected to last significantly longer and perform with significantly greater accuracy than prior art devices.

One-Piece System

Figure 9:
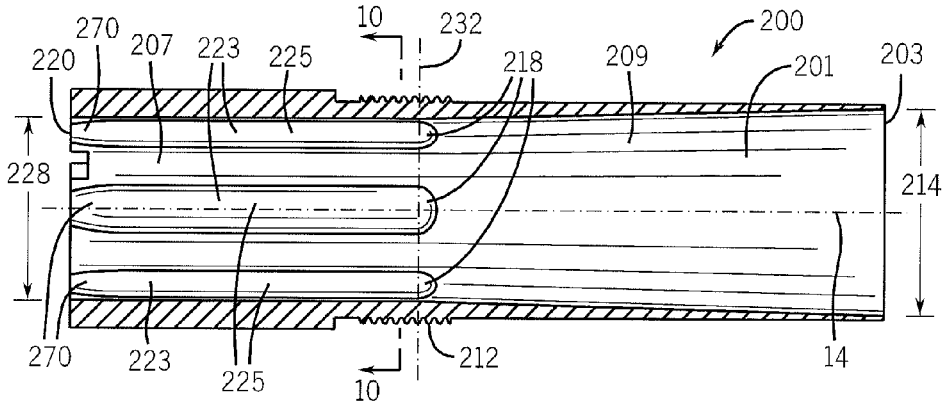
FIG. 9 is a side sectional view of a unitary embodiment of the present invention.
Figure 10:
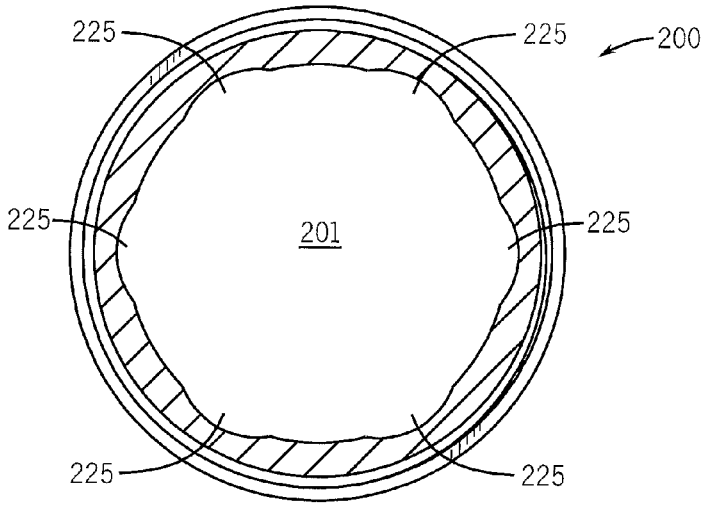
FIG. 10 is a cross sectional view from the muzzle end of the embodiment according to FIG. 9 taken across line 10-10.

A unitary or one-piece shot pattern control system or choke is illustrated by FIGS. 9 and 10 that is preferably made from a hardened alloy such as tungsten steel, but may be fabricated from a variety of other metal or composite materials as would be known to those of skill in the gunsmith arts. Shot pattern control system 200 provides an inner cylindrical chamber 201 that extends longitudinally between rear opening 203 facing the chamber end of the weapon and a forward or muzzle opening 220 on the opposite end. Inner substantially cylindrical chamber 201 may be divided into a forward section 207 located in front of a median transverse plane 232 and a rear section 209 located behind it. Inner cylindrical chamber 201 tapers from the rear to muzzle opening 220.

Inner chamber 201 of the unitary embodiment is substantially centered on a longitudinal axis 14. In the present embodiment, a number of longitudinal channels 225 are provided along the inner sidewall of shot pattern system 200 starting in rear section 209 prior to median transverse plane 232 and extending through forward section 207 to muzzle opening 220. Although a portion of channel 225 has to be in forward section 207, it does not need to extend to muzzle opening 220. The location of transverse plane 232 and the length of channels 225 that is in rear section 209 relative to that in forward section 207 can vary in accordance with the needs of the user.

Just as vents 118 of the two piece system act as valves that convey gas laterally into a chamber 123 located between the outside wall of tube 102 and the inside wall of collar 104, in the unitary system, the portions of channels 225 that are found in rear section 209 referenced as vents 218 act as valves that convey gas laterally along channel 225. Accordingly, whereas chamber 123 of the two piece system was separated by dividers 124 into channels 125, in the unitary system, channels 225 perform the function of chamber 123 by allowing the gas to laterally expand from rear section 209 into forward section 207 and ultimately out chamber 201. To be consistent with the two piece system, the sections of channels of 225 in forward section 207 will be referenced as outer chambers 223. As shown, a ring of six equally spaced channels 225 of the same size that are generally oval in shape and are substantially oriented with the long oval axes parallel to axis 214 provide a radially balanced distribution of gas. While six radial channels 225 are shown, greater or lesser number of channels may provide alternative embodiments.

Similar to that of tube 102 of the two-piece system, the sidewalls that form inner chamber 201 of the unitary system tapers from rear opening 203 to muzzle opening 220. However, unlike the two-piece system, the tapering extends past median plane 232, decreasing uniformly from a first diameter 214 corresponding to the bore of the gun barrel to a second diameter 228 as it extends to muzzle end opening 220. First diameter 214 is dimensioned to correspond to the gauge of the barrel to which the shot pattern control device 200 attaches. The continuous tapering slightly narrows the diameter of chamber 201 to less than the outside diameter of the shot wad to ensure that radial vents 218 are tightly sealed and propulsion gas pressure is maintained behind the wad until the wad has advanced past the vents. After the wad and shot column have advanced past vents 218, propulsion gas is allowed to escape laterally and expand forward into outer chambers 223.

The taper of forward section 207 is dimensioned to sealingly engage the forward portion of the wad substantially at the same time as the rear portion has cleared radial vents 218. Thus a radially balanced pressure begins to build in forward section 207 against the wad as soon as gas is allowed into chambers 223. As with the two-piece system, the longitudinal positioning of radial vents 218 is determined so that the openings are exposed when the wad has cleared the openings and its forward end is in forward section 207 with its sidewall biased sealingly against the tapered bore, the exact longitudinal positioning depending on the length of the wad.

In the two-piece example, collar 104 tapers uniformly from third diameter 130 to muzzle diameter 128. This tapering contributes to the inwardly directed radial forces provided by laterally escaping gas. The continuous taper for inner chamber 201, provides a similar contribution in forward section 207. However, because the gasses are substantially trapped in chambers 223, a second taper and narrowing is provided at the muzzle end within channels 225. Focusing sections 270 also directs the gas pressure to provide an inwardly directed radial force.

Similar to the two-piece embodiment, a variety of methods may be used to attach the one-piece system to the firearm. As shown, external threads 212 are provided on the outer sidewall surface of system 200 for engaging internal threads conventionally provided for muzzle attachments at the muzzle end of firearm barrel.

The operation of the unitary system is substantially similar to that of the two piece system and will not be repeated here, except that focusing sections 270 also directs the lateral gas pressure inwardly.

CONCLUSION

As has been shown, embodiments according to the present invention provide effective and efficient systems, methods and devices to control the pattern of multiple projectiles discharged from the muzzle of a weapon. A number of embodiments of the invention defined by the following claims have been described. Nevertheless, it will be understood that various modifications to the described embodiments may be made without departing from the spirit and scope of the claimed invention. For example, while embodiments of the present invention have been illustrated in connection with shotguns, alternative embodiments of the present invention may likewise find use in a number of other multiple projectile weapons systems and devices, including small caliber weapons such as handguns and larger caliber weapons such as cannon, howitzers, missile launchers, and the like. As noted above, certain components have been described as an assembly of parts or an assembly that is separable. In alternative embodiments, such components may be of unitary construction or may be made from multiple parts that are not designed to be separable. For example, a one-piece embodiment according to the present invention may be made by an investment casting process, in which wax or another easily removable material is used to form chambers, passageways, supports and spacers that are eliminated in the casting process. Such a unitary construction will remove parts that are subject to wear and tear such as threads between components that can become stripped or worn and may also result in lower manufacturing costs.

In addition to the integration of tube and collar in a one-piece construction, as discussed above, alternative embodiments of the present invention may be integrated into the construction of a gun barrel. Additionally, while the collar has been illustrated as extending from a median plane forward, in alternative embodiments, the collar may be of a different length, including, for example, an external sleeve that extends over the entire length of the tube. Accordingly, other embodiments are within the scope of the invention, which is limited only by the following claims.

What is claimed is:

1. A unitary shot pattern control system for a multiple projectile load firing weapon comprising an inner substantially cylindrical chamber defined by a sidewall having a rear opening and a muzzle opening, wherein the multiple projectile load comprises multiple projectiles sealed by a wad;

the inner cylindrical chamber is divided at a median transverse plane into a forward section that terminates at the muzzle opening and a rear section that terminates at the rear opening, and a plurality of longitudinal channels extend from the rear section into the forward section;

the channels are dimensioned such that when the multiple projectile load is fired, the resulting propulsion gas is initially sealed behind a wad containing the multiple projectile load until the wad has advanced, beyond the beginnings of the longitudinal channels;

the channels are positioned such that once the wad has advanced beyond the beginnings of the longitudinal channels, a portion of the propulsion gas laterally expands into the channel; and the forward section of the inner chamber is dimensioned to sealingly engage the wad after it has advanced past the radial vents to cause gas pressure in the channels to build.

2. A unitary shot pattern control system according to claim 1, wherein each channel has a focusing section which forces the laterally expanded gas to exert a radially balanced inwardly directed force against the wad and the projectiles.

3. A unitary shot pattern control system according to claim 2, wherein the focusing section forces the laterally expanded gas pressure to exert a radially balanced inwardly directed force against the wad and the projectiles at the muzzle opening.

4. A unitary shot pattern control system according to claim 3, wherein the focusing section forces the laterally expanded gas pressure to exert a radially balanced inwardly directed force against the wad and the projectiles within the forward section.

* * * * *